US010435866B2

(12) United States Patent
Yudate et al.

(10) Patent No.: US 10,435,866 B2
(45) Date of Patent: Oct. 8, 2019

(54) DRIVE CONTROL SYSTEM OF OPERATING MACHINE, OPERATING MACHINE INCLUDING DRIVE CONTROL SYSTEM, AND DRIVE CONTROL METHOD OF OPERATING MACHINE

(71) Applicant: KAWASAKI JUKOGYO KABUSHIKI KAISHA, Kobe-shi, Hyogo (JP)

(72) Inventors: Yoji Yudate, Kobe (JP); Kazuya Iwabe, Kobe (JP); Hideyasu Muraoka, Akashi (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 15/541,460

(22) PCT Filed: Dec. 24, 2015

(86) PCT No.: PCT/JP2015/006453
§ 371 (c)(1),
(2) Date: Jul. 3, 2017

(87) PCT Pub. No.: WO2016/110926
PCT Pub. Date: Jul. 14, 2016

(65) Prior Publication Data

US 2017/0350094 A1 Dec. 7, 2017

(30) Foreign Application Priority Data

Jan. 6, 2015 (JP) ..... 2015-000773

(51) Int. Cl.
*E02F 9/12* (2006.01)
*B66C 23/84* (2006.01)
(Continued)

(52) U.S. Cl.
CPC ..... *E02F 9/123* (2013.01); *B66C 23/84* (2013.01); *B66C 23/86* (2013.01); *E02F 9/128* (2013.01);
(Continued)

(58) Field of Classification Search
CPC ... E02F 9/123; E02F 9/128; E02F 9/20; E02F 9/2058; E02F 9/2091; E02F 9/22; E02F 3/32; B66C 23/84; B66C 23/86
See application file for complete search history.

(56) References Cited

U.S. PATENT DOCUMENTS 5,931,245 A * 8/1999 Uetake ..... B60L 3/00 180/65.8
9,605,410 B2 * 3/2017 Kitamura ..... E02F 9/123
(Continued)

FOREIGN PATENT DOCUMENTS

JP 2011-241653 A 12/2011
JP 2012-6253 A1 1/2012
(Continued)

OTHER PUBLICATIONS

Mar. 22, 2016 Search Report issued in International Patent Application No. PCT/JP2015/006453.

*Primary Examiner* — Behrang Badii
*Assistant Examiner* — Daniel L Greene
(74) *Attorney, Agent, or Firm* — Oliff PLC

(57) ABSTRACT

A drive control system includes an electric motor, a capacitor, a revolution sensor, a driving device, and a control device. The driving device causes the capacitor to supply electric power to the electric motor to operate the electric motor and causes the capacitor to store the electric power, generated by the electric motor, to brake a turning body. The driving device configured as above is driven by driving electric power supplied from the capacitor. When a charging
(Continued)

stop condition is satisfied, the control device stops the driving electric power supplied from the capacitor to the driving device. The charging stop condition is a condition that a turning speed detected by the revolution sensor is a predetermined speed or less while the turning body is decelerating.

9 Claims, 6 Drawing Sheets

(51) Int. Cl.

| | |
|---|---|
| ***B66C 23/86*** | (2006.01) |
| ***E02F 9/20*** | (2006.01) |
| ***E02F 9/22*** | (2006.01) |
| ***F15B 11/08*** | (2006.01) |
| ***E02F 3/32*** | (2006.01) |
| ***F15B 15/20*** | (2006.01) |

(52) U.S. Cl.
CPC ..... *E02F 9/2058* (2013.01); *E02F 9/2091* (2013.01); *E02F 9/22* (2013.01); *E02F 9/2217* (2013.01); *F15B 11/08* (2013.01); *E02F 3/32* (2013.01); *E02F 9/2296* (2013.01); *F15B 2015/206* (2013.01); *F15B 2211/50518* (2013.01); *F15B 2211/526* (2013.01); *F15B 2211/565* (2013.01); *F15B 2211/7058* (2013.01)

(56) References Cited

U.S. PATENT DOCUMENTS 9,725,008 B2 * 8/2017 Wu ..... B60K 6/48
2010/0332061 A1 * 12/2010 Forslow ..... B60W 10/24 701/22
2011/0251746 A1 * 10/2011 Wu ..... B60K 6/48 701/22
2011/0273141 A1 * 11/2011 Kanbayashi ..... B60K 6/48 320/134
2012/0082536 A1 * 4/2012 Kawashima ..... B60W 10/08 414/694
2013/0058750 A1 3/2013 Hiroki et al.
2014/0145657 A1 * 5/2014 Takeo ..... E02F 9/123 318/400.21
2014/0147238 A1 * 5/2014 Izumi ..... E02F 9/2091 414/687
2014/0222274 A1 * 8/2014 Sugiyama ..... E02F 9/2075 701/22
2014/0229078 A1 * 8/2014 Takeo ..... E02F 9/2091 701/50
2014/0277970 A1 * 9/2014 Sakamoto ..... E02F 9/123 701/50
2015/0142276 A1 * 5/2015 Wu ..... E02F 9/128 701/50
2015/0224845 A1 * 8/2015 Anderson ..... B60G 17/019 701/37
2016/0040690 A1 2/2016 Yudate et al.
2016/0122980 A1 * 5/2016 Kondo ..... E02F 9/18 414/687
2017/0335547 A1 * 11/2017 Wu ..... E02F 9/2246

FOREIGN PATENT DOCUMENTS

JP 2012-62653 A 3/2012
JP 2014-201978 A 10/2014
WO 2012/161062 A1 11/2012

* cited by examiner

DRIVE CONTROL SYSTEM OF OPERATING MACHINE, OPERATING MACHINE INCLUDING DRIVE CONTROL SYSTEM, AND DRIVE CONTROL METHOD OF OPERATING MACHINE

TECHNICAL FIELD

The present invention relates to a drive control system of an operating machine, the operating machine including the drive control system, and a drive control method of the operating machine, the drive control system being configured to: cause an electric motor to drive a turning body of the operating machine; and cause the electric motor to regenerate energy when braking the turning body.

BACKGROUND ART

Operating machines, such as hydraulic excavators and cranes, are publicly known. These operating machines can perform various work by moving operating devices such as shovels and cranes. Such operating machine includes a lower body configured to be able to travel. A revolving super structure is provided on the lower body. The operating device, such as the shovel or the crane, is attached to the revolving super structure. The revolving super structure is configured to be turnable relative to the lower body and can change a direction of the operating device. The revolving super structure configured as above is configured to be able to be turned by a drive control system.

One example of the drive control system is disclosed in PTL 1. The drive control system of PTL 1 includes a hydraulic motor and an electric motor. The electric motor and the hydraulic motor cooperate with each other to turn the revolving super structure. The hydraulic motor is driven by pressure oil discharged from a hydraulic pump, and the electric motor is driven by electric power supplied from a power storage device. The electric motor has a power generating function. The electric motor converts kinetic energy of the revolving super structure during turning into electric power to brake the revolving super structure. The converted electric power is stored in the power storage device and is utilized for next driving.

CITATION LIST

Patent Literature

PTL 1: Japanese Laid-Open Patent Application Publication No. 2012-62653

SUMMARY OF INVENTION

Technical Problem

A system, such as the drive control system of PTL 1, including an electric motor includes a driving device (for example, an inverter) for driving the electric motor. The driving device has a conversion function such as an AC-DC conversion function or a voltage conversion function. By this conversion function, the driving device increases a revolution of the electric motor to accelerate the revolving super structure. In addition, the driving device causes the electric motor to generate electric power and causes the power storage device to store the electric power to brake the revolving super structure. To the driving device and the electric motor configured as above, standby electric power is supplied from the power storage device regardless of whether or not the driving device and the electric motor are driving. Therefore, energy is being lost steadily, that is, steady loss is occurring. On the other hand, the electric power generated by the electric motor at the time of braking decreases as a speed of the revolving super structure decreases. Therefore, as the revolution of the electric motor decreases at the time of the braking, the electric power generated by the electric motor becomes smaller than the steady loss of the electric motor and the driving device in some cases. In such a case, even at the time of the braking, the electric power stored in the power storage device is consumed, and regeneration efficiency of the entire drive control system deteriorates.

An object of the present invention is to provide a drive control system capable of improving the regeneration efficiency.

Solution to Problem

A drive control system of an operating machine according to the present invention includes: an electric motor configured to receive supply of electric power to turn a turning body of the operating machine and configured to generate the electric power to brake the turning body; a power storage device configured to charge and discharge the electric power; a driving device driven by driving electric power supplied from the power storage device, configured to cause the power storage device to supply the electric power to the electric motor to operate the electric motor, and configured to cause the power storage device to store the electric power, generated by the electric motor, to brake the turning body; a speed detector configured to detect a turning speed of the turning body; and a control device configured to stop the supply of the driving electric power from the power storage device to the driving device when the turning body decelerates, and a charging stop condition is satisfied, the charging stop condition including a condition that the turning speed detected by the speed detector is a predetermined speed or less.

According to the present invention, when the turning speed becomes the predetermined speed or less, the supply of the driving electric power to the driving device is stopped. Therefore, it is possible to prevent a case where the electric power of the power storage device is consumed by the steady loss of the driving device and the electric motor at the time of deceleration braking. With this, the electric power, which was consumed by the steady loss in conventional cases, can be utilized when driving the turning body next time. Therefore, the regeneration efficiency of the drive control system can be improved.

In the above invention, the drive control system may further include: a liquid pressure motor configured to receive supply of a pressure liquid to turn the turning body in cooperation with the electric motor; and a liquid pressure supply device configured to supply the pressure liquid to the liquid pressure motor, wherein: the liquid pressure motor may brake the turning body in such a manner that discharge pressure of the liquid pressure motor is made higher than supply pressure supplied to the liquid pressure motor; the liquid pressure supply device may adjust the discharge pressure of the liquid pressure motor; and when the charging stop condition is satisfied, the control device may control an operation of the liquid pressure supply device to increase the discharge pressure of the liquid pressure motor.

According to the above configuration, after the driving device stops, the turning body can be braked by the liquid pressure motor. With this, even after the supply of the driving electric power to the driving device is stopped, the braking force can be applied to the turning body to stop the turn of the turning body.

In the above invention, the drive control system may further include a rotation braking unit configured to brake rotation of an output shaft shared by the liquid pressure motor and the electric motor, wherein when the charging stop condition is satisfied, the control device may control an operation of the rotation braking unit to brake the rotation of the output shaft.

According to the above configuration, after the driving device stops, the turning body can be braked by the rotation braking unit. With this, even after the supply of the driving electric power to the driving device is stopped, the braking force can be applied to the turning body to stop the turn of the turning body.

In the above invention, the drive control system may further include an input device to which an adjustment value regarding the turning speed of the turning body is input, wherein: the control device may control operations of the driving device and the liquid pressure supply device such that the turning speed of the turning body becomes a turning speed corresponding to an adjustment command output from the input device; and the charging stop condition may include a condition that the adjustment value output from the input device is a predetermined value or less.

According to the above configuration, when the turning speed of the turning body is the predetermined speed or less, and the adjustment value output from the input device is the predetermined value or less, the supply of the driving electric power to the driving device is stopped. With this, when the turning speed of the turning body is the predetermined speed or less, and the adjustment value output from the input device is the predetermined value or less, it is possible to prevent a case where the electric power of the power storage device is consumed by the steady loss of the driving device and the electric motor, the steady loss being generated when, for example, the turning body is stopped.

A drive control system according to the present invention includes: a liquid pressure motor configured to receive supply of a pressure liquid to turn a turning body; a liquid pressure supply device configured to supply the pressure liquid to the liquid pressure motor; an electric motor configured to receive supply of electric power to turn the turning body in cooperation with the liquid pressure motor and configured to generate the electric power to brake the turning body; a power storage device configured to charge and discharge the electric power; a driving device driven by driving electric power supplied from the power storage device, configured to cause the power storage device to supply the electric power to the electric motor to operate the electric motor, and configured to cause the power storage device to store the electric power, generated by the electric motor, to brake the turning body; a speed detector configured to detect a turning speed of the turning body; and a control device configured to stop the supply of the driving electric power from the power storage device to the driving device when the turning body accelerates or turns at a constant speed, and an assist stop condition is satisfied, the assist stop condition including a condition that an amount of electric power stored in the power storage device is a predetermined value or less.

According to the present invention, when the amount of electric power stored in the power storage device becomes the predetermined value or less, the supply of the driving electric power to the driving device is stopped. Therefore, it is possible to prevent a case where the electric power of the power storage device is consumed by the steady loss of the driving device and the electric motor at the time of the acceleration or the constant-speed turning. With this, the electric power, which was consumed by the steady loss in conventional cases, can be utilized when driving the turning body next time. Therefore, the regeneration efficiency of the drive control system can be improved.

An operating machine according to the present invention includes: the drive control system according to the above; and the turning body, wherein the electric motor turns the turning body via a reducer.

According to the above configuration, it is possible to realize the operating machine having the above-described operational advantages.

A drive control method according to the present invention includes: a speed detecting step of detecting a turning speed of a turning body of an operating machine, the turning body being turned by an electric motor being driven by electric power supplied from a power storage device; a determining step of determining whether or not a charging stop condition is satisfied when the turning body is decelerated in such a manner that the driving device stores the electric power, generated by the electric motor, in the power storage device to brake the turning body, the charging stop condition including a condition that the turning speed detected in the speed detecting step is a predetermined speed or less, or a determining step of determining whether or not an assist stop condition is satisfied when the turning body accelerates or turns at a constant speed, the assist stop condition including a condition that an amount of electric power stored in the power storage device is a predetermined value or less; and a stopping step of stopping the supply of the electric power from the power storage device to the driving device when it is determined in the determining step that the charging stop condition or the assist stop condition is satisfied.

According to the present invention, when the turning speed becomes the predetermined speed or less, or when the amount of electric power stored becomes the predetermined value or less, the supply of the driving electric power to the driving device is stopped. Therefore, it is possible to prevent a case where the electric power of the power storage device is consumed by the steady loss of the driving device and the electric motor at the time of the deceleration braking. With this, the electric power, which was consumed by the steady loss in conventional cases, can be utilized when driving the turning body next time. Thus, the regeneration efficiency of the drive control system can be further improved.

Advantageous Effects of Invention

The present invention can improve the regeneration efficiency.

The above object, other objects, features, and advantages of the present invention will be made clear by the following detailed explanation of preferred embodiments with reference to the attached drawings.

DESCRIPTION OF EMBODIMENTS

Hereinafter, the configurations of drive control systems 1, 1A, and 1B according to Embodiments 1, 2, and 3 of the present invention and the configuration of a hydraulic excavator 2 including the drive control system 1, 1A, or 1B will be explained in reference to the drawings. Directions stated in the embodiments are used for convenience of explanation, and the arrangement, directions, and the like of components in the drive control systems 1, 1A, and 1B and the hydraulic excavator 2 are not limited. The configurations and control of the drive control systems 1, 1A, and 1B and the configuration and control of the hydraulic excavator 2 explained below are just embodiments of the present invention, and the present invention is not limited to the embodiments. Additions, deletions, and modifications may be made within the scope of the present invention.

Hydraulic Excavator

Figure 1:
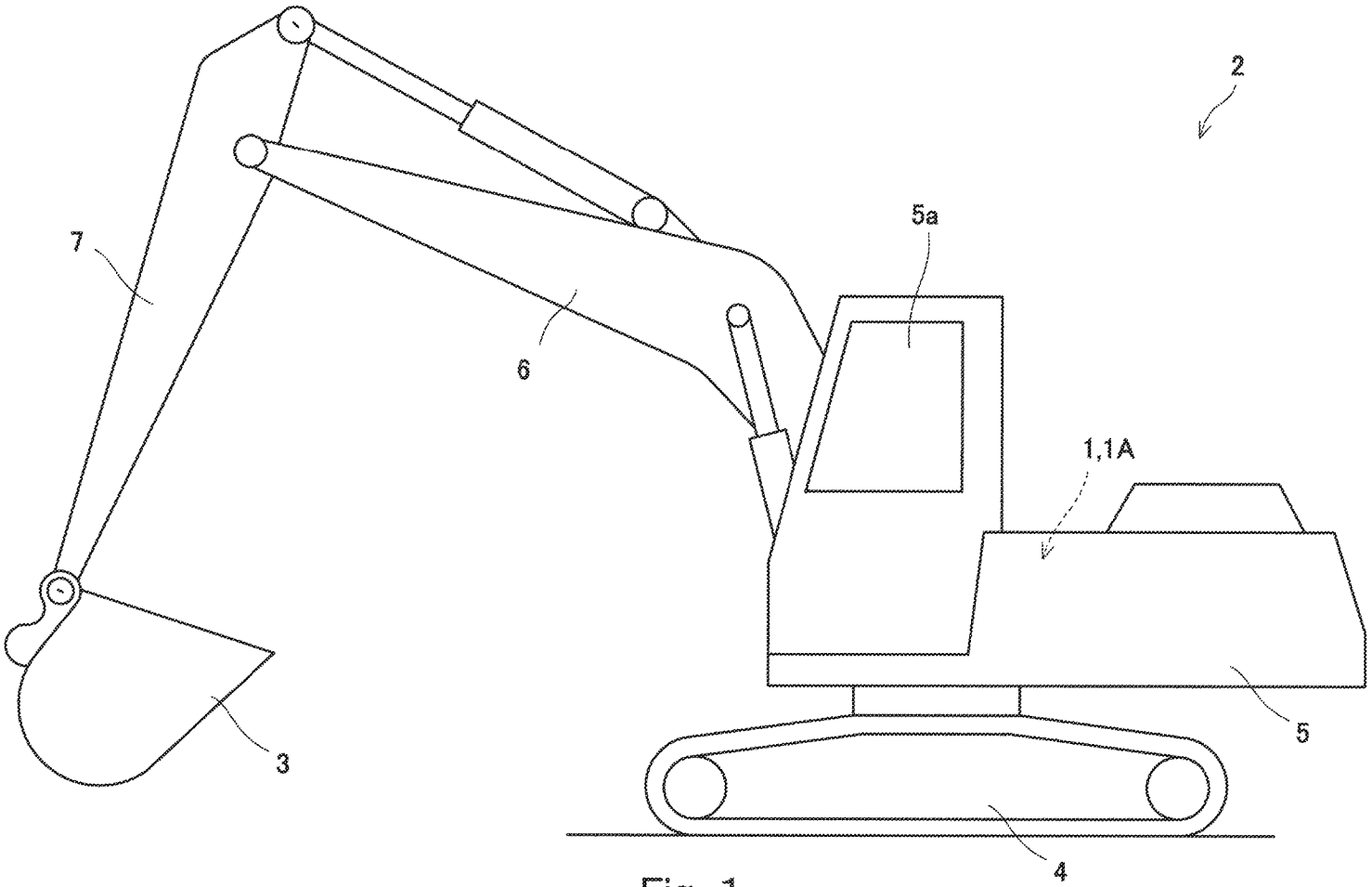
FIG. 1 is a side view showing a hydraulic excavator including a drive control system according to Embodiments 1 to 3 of the present invention.

As shown in FIG. 1, the hydraulic excavator 2 that is one example of an operating machine can perform various work, such as excavation and carriage, by an attachment such as a bucket 3 attached to a tip end portion of the hydraulic excavator 2. The hydraulic excavator 2 includes a travelling device 4, such as a crawler. A turning body 5 is placed on the travelling device 4. A driver's seat 5*a* in which a driver gets is set on the turning body 5. The turning body 5 is further provided with the bucket 3 via a boom 6 and an arm 7. The turning body 5 configured as above is configured to be able to turn relative to the travelling device 4. The hydraulic excavator 2 includes the drive control system 1 which turns the turning body 5. Hereinafter, the configuration of the drive control system 1 of the hydraulic excavator 2 will be explained in reference to FIG. 2.

Drive Control System

The drive control system 1 mainly includes a hydraulic pump 10, a control valve 11, a remote control valve 12, two electromagnetic pressure reducing valves 13 and 14, two electromagnetic relief valves 15 and 16, and an electrohydraulic turning motor 17. The hydraulic pump 10 that is a liquid pressure pump is a variable displacement swash plate type hydraulic pump. The hydraulic pump 10 is driven by an engine (not shown) to discharge operating oil. The hydraulic pump 10 includes a swash plate 10*a*. By tilting the swash plate 10*a*, the amount of operating oil discharged can be changed. A regulator 18 is connected to the swash plate 10*a*.

The regulator 18 includes a servo piston (not shown). The servo piston is coupled to the swash plate 10*a*. The swash plate 10*a* tilts at a tilting angle corresponding to a position of the servo piston. The regulator 18 is connected to a pilot pump 20 through an electromagnetic pressure reducing valve 19. The servo piston is configured to move to a position corresponding to command pressure p0 discharged from the electromagnetic pressure reducing valve 19. Further, the electromagnetic pressure reducing valve 19 outputs the command pressure p0 obtained by pressure reduction in accordance with a command signal input thereto. Therefore, the swash plate 10*a* tilts at a tilting angle corresponding to the command signal, and the operating oil is discharged through an outlet port 10*b* of the hydraulic pump 10 at a flow rate corresponding to the tilting angle. The control valve 11 is connected to the outlet port 10*b* through a discharge passage 21.

The control valve 11 is a spool valve including a spool 22. By moving the spool 22, the control valve 11 can change a connection destination of the hydraulic pump 10 and the flow rate of the operating oil flowing through the connection destination. Two pilot passages 23 and 24 are connected to the control valve 11, and the remote control valve 12 is connected to the control valve 11 through the pilot passages 23 and 24.

The remote control valve 12 that is an input device is a device to which a target turning speed is input. It should be noted that the input device is not limited to a hydraulic device and may be an electric device. The remote control valve 12 includes an operating lever 25. The operating lever 25 can incline toward one side and the other side in a predetermined direction. The remote control valve 12 outputs pilot oil to the pilot passage 23 or 24 corresponding to an inclination direction of the operating lever 25, the pilot oil having pressure corresponding to an inclination amount (adjustment value) of the operating lever 25. Pilot pressure sensors 26 and 27 are connected to the pilot passages 23 and 24, respectively. Further, the electromagnetic pressure reducing valves 13 and 14 are disposed on the pilot passages 23 and 24, respectively. Each of the pilot pressure sensors 26 and 27 detects the oil pressure output from the remote control valve 12. The electromagnetic pressure reducing valves 13 and 14 are so-called normally open pressure reducing valves. The electromagnetic pressure reducing valve 13 can reduce and adjust the pressure of the pilot oil, output from the remote control valve 12, to pressure corresponding to a current (command value) flowing through the electromagnetic pressure reducing valve 13, and the electromagnetic pressure reducing valve 14 can reduce and adjust the pressure of the pilot oil, output from the remote control valve 12, to pressure corresponding to a current (command value) flowing through the electromagnetic pressure reducing valve 14. The pilot oil output from the remote control valve 12 is introduced to both end portions of the spool 22 through the pilot passages 23 and 24. The spool 22 receives pilot pressure p1 and pilot pressure p2 which are oil pressure of the pilot oil introduced to both end portions of the spool 22. The spool 22 moves to a position corresponding to the pilot pressure p1 and the pilot pressure p2. By the movement of the spool 22, the control valve 11 changes the connection destination of the hydraulic pump 10 and the flow rate of the operating oil flowing through the connection destination.

The configuration of the control valve 11 will be specifically explained. The control valve 11 includes four ports 11*a* to 11*d*. The first port 11*a* is connected to the hydraulic pump 10 through the discharge passage 21. The second port 11*b* is connected to a tank 29 through a tank passage 30. The third port 11*c* is connected to the electrohydraulic turning motor 17 through a first oil passage 31, and the fourth port 11*d* is connected to the electrohydraulic turning motor 17 through a second oil passage 32. The connection destination of each of these four ports 11*a* to 11*d* changes in accordance with the position of the spool 22. More specifically, when the spool 22 is located at a neutral position M1, the first port 11*a* and the second port 11*b* are connected to each other, and the hydraulic pump 10 becomes an unload state. When the spool 22 moves to a first offset position A1, the first port 11*a* and the third port 11*c* are connected to each other, and the second port 11*b* and the fourth port 11*d* are connected to each other. When the spool 22 moves to a second offset position A2, the first port 11*a* and the fourth port 11*d* are connected to each other, and the second port 11*b* and the third port 11*c* are connected to each other. When the spool 22 is located at the first or second offset position A1 or A2, the hydraulic pump 10 and the electrohydraulic turning motor 17 are connected to each other, and the operating oil is supplied to the electrohydraulic turning motor 17.

The electrohydraulic turning motor 17 includes a hydraulic motor 33, an electric motor 34, and an output shaft 35. The output shaft 35 is connected to the turning body 5 through a reducer (not shown). By rotating the output shaft 35, the turning body 5 turns. The hydraulic motor 33 and the electric motor 34 are configured integrally and cooperate with each other to rotate the output shaft 35. To be specific, the output shaft 35 serves as both an output shaft of the hydraulic motor 33 and an output shaft of the electric motor 34, that is, the output shaft 35 is shared by the hydraulic motor 33 and the electric motor 34. Hereinafter, the configuration of the hydraulic motor 33 and the configuration of the electric motor 34 will be explained in detail.

The electric motor 34 is, for example, a three-phase AC motor and includes a stator and a rotor (both not shown). The rotor is provided so as not to be rotatable relative to the output shaft 35, and the stator is provided so as not to be rotatable relative to the hydraulic motor 33. The rotor and the stator are configured so as to be rotatable relative to each other. By supplying a three-phase alternating current (hereinafter may be simply referred to as an "alternating current") to a coil of the stator, the output shaft 35 is rotated normally or reversely at a revolving speed corresponding to a frequency of the alternating current. The electric motor 34 has a power generating function of converting rotational energy (kinetic energy) of the output shaft 35 into electric energy to generate the alternating current. By the power generation, the rotating output shaft 35 is decelerated.

The electric motor 34 configured as above is electrically connected to a driving device 36 and is further electrically connected to a capacitor 28 through the driving device 36. The driving device is a device including an inverter and a chopper. The capacitor 28 can store electric power and discharges a direct current to the driving device 36. The inverter and chopper of the driving device 36 include respective switching elements. By turning on or off these switching elements, the driving device 36 converts the direct current, discharged from the capacitor 28, into an alternating current to supply the alternating current to the electric motor 34. The driving device 36 has a frequency adjusting function of adjusting a frequency of the alternating current, supplied to the electric motor 34, to a frequency corresponding to the command value. By adjusting the frequency of the alternating current, the driving device 36 changes a revolution of the output shaft 35. Further, by turning on or off the switching elements, the driving device 36 converts the alternating current, generated by the electric motor 34, into the direct current to output the direct current to the capacitor 28. The capacitor 28 stores the direct current output from the driving device 36.

In the driving device 36 configured as above, the switching elements of the inverter and the chopper are turned on or off in accordance with a command from a below-described control device 50. By turning on or off the switching elements, the capacitor 28 and the driving device 36 are connected to each other or disconnected from each other. By disconnecting the capacitor 28 and the driving device 36 from each other, the supply of driving electric power for driving the driving device 36 is stopped. With this, the steady loss of the driving device 36 can be stopped. In the present embodiment, a servo off circuit is constituted by the switching elements of the inverter and the chopper but does not necessarily have to be constituted by the switching elements. To be specific, the servo off circuit does not necessarily have to be included in the driving device 36. A servo off circuit including a switching element and the like may be separately provided outside the driving device 36, and a control operation regarding the above-described electric power supply to the driving device 36 may be performed.

The hydraulic motor 33 is, for example, a fixed displacement hydraulic motor and includes two supplying/discharging ports 33*a* and 33*b*. The first oil passage 31 is connected to the first supplying/discharging port 33*a*, and the second oil passage 32 is connected to the second supplying/discharging port 33*b*. When the operating oil is supplied to the first supplying/discharging port 33*a*, the hydraulic motor 33 applies torque, corresponding to the pressure and flow rate of the operating oil, to the output shaft 35 in a forward direction. When the operating oil is supplied to the second supplying/discharging port 33*b*, the hydraulic motor 33 applies torque, corresponding to the pressure and flow rate of the operating oil, to the output shaft 35 in an opposite direction. To be specific, the hydraulic motor 33 applies assist torque, corresponding to the pressure and flow rate of the supplied operating oil, to the output shaft 35 to assist the rotation of the output shaft 35. The operating oil for driving the hydraulic motor 33 is supplied to the hydraulic motor 33 by an operating oil supply device 9.

The operating oil supply device (liquid pressure supply device) 9 is mainly constituted by the hydraulic pump 10, the control valve 11, and the two electromagnetic pressure reducing valves 13 and 14 and further includes the two electromagnetic relief valves 15 and 16. The electromagnetic relief valves 15 and 16 are connected to the first oil passage 31 and the second oil passage 32, respectively, and are arranged such that the operating oil in the first oil passage 31 can be discharged to the tank 29 through the electromagnetic relief valve 15, and the operating oil in the second oil passage 32 can be discharged to the tank 29 through the electromagnetic relief valve 16. Each of the electromagnetic relief valves 15 and 16 arranged as above has a pressure adjusting function of adjusting the pressure of the operating oil, to be discharged to the tank 29, to pressure corresponding to a current (command value) flowing therethrough. The operating oil supply device 9 can brake and decelerate the output shaft 35 in such a manner that: the tank 29 and the discharge-side oil passage 31 or 32 are disconnected from each other by the control valve 11; and the operating oil is discharged through the electromagnetic relief valve 15 or 16. Then, braking force acting on the output shaft 35 is changed in such a manner that the pressure of the oil in the discharge-side oil passage 31 or 32 is adjusted by the electromagnetic relief valve 15 or 16 serving as a rotation braking unit for the output shaft 35.

The operating oil supply device 9 further includes relief valves 38 and 39 and check valves 40 and 41. The relief valve 38 and the check valve 40 are connected to the first oil passage 31, and the relief valve 39 and the check valve 41 are connected to the second oil passage 32. The relief valve 38 opens the oil passage 31 to the tank 29 when the pressure of the operating oil flowing through the oil passage 31 exceeds an operating pressure limit, and the relief valve 39 opens the oil passage 32 to the tank 29 when the pressure of the operating oil flowing through the oil passage 32 exceeds the operating pressure limit. By opening the oil passage 31 or 32, damages on the drive control system 1 are suppressed. The check valves 40 and 41 are connected to the tank 29. The check valve 40 allows the flow of the operating oil from the tank 29 to the oil passage 31 and blocks the reverse flow of the operating oil, and the check valve 41 allows the flow of the operating oil from the tank 29 to the oil passage 32 and blocks the reverse flow of the operating oil. With this, the shortage of the operating oil which is necessary when driving the hydraulic motor 33 can be introduced from the tank 29 through the check valves 40 and 41 to the hydraulic motor 33.

Further, oil pressure sensors 42 and 43 are provided at the first oil passage 31 and the second oil passage 32, respectively. Oil pressure supplied to the supplying/discharging port 33*a* of the hydraulic motor 33 and oil pressure supplied to the supplying/discharging port 33*b* of the hydraulic motor 33 are detected by the oil pressure sensors 42 and 43, respectively. A revolution sensor 44 is provided at the output shaft 35 of the electrohydraulic turning motor 17. The revolution sensor 44 detects the revolution of the output shaft 35 (i.e., the revolving speed of the output shaft 35). The sensors 42 to 44 and the pilot pressure sensors 26 and 27 are electrically connected to the control device 50 which controls various components. The sensors 42 to 44 and the pilot pressure sensors 26 and 27 transmit detected values to the control device 50. Specifically, the oil pressure detected by the oil pressure sensor 42 and the oil pressure detected by the oil pressure sensor 43 are input to the control device 50, and differential pressure therebetween becomes a differential pressure feedback signal DP. The pilot pressure detected by the pilot pressure sensor 26 and the pilot pressure detected by the pilot pressure sensor 27 are input to the control device 50, and differential pressure therebetween becomes a speed command signal VCOM. The revolution detected by the revolution sensor 44 is input to the control device 50 and becomes a speed feedback signal VFB.

The control device 50 is electrically connected to the electromagnetic pressure reducing valves 13 and 14, the electromagnetic relief valves 15 and 16, the electromagnetic pressure reducing valve 19, and the driving device 36. The control device 50 supplies command values, corresponding to various signals from the sensors 26, 27, and 42 to 44, to the valves 13 to 16 and 19 and the driving device 36 to control the operations of the valves 13 to 16 and 19 and the driving device 36. By controlling the operations of the valves 13 to 16 and 19 and the driving device 36, the hydraulic motor 33 and the electric motor 34 are driven, and therefore, the turning body 5 turns to perform a desired operation (in a desired rotational direction at a desired speed). Further, by controlling the operations of the valves 13 to 16 and 19 and the driving device 36, the control device 50 can cause the hydraulic motor 33 and the electric motor 34 to serve as braking units and brake the turning body 5 that is turning. Furthermore, the steady loss generated by the electric motor 34 and the driving device 36 at the time of the braking can be eliminated. Hereinafter, the control operations of the control device 50 will be explained in reference to the flow chart of FIG. 3 and the sequence diagram of FIG. 4.

Control Operations of Control Device

Figure 2:
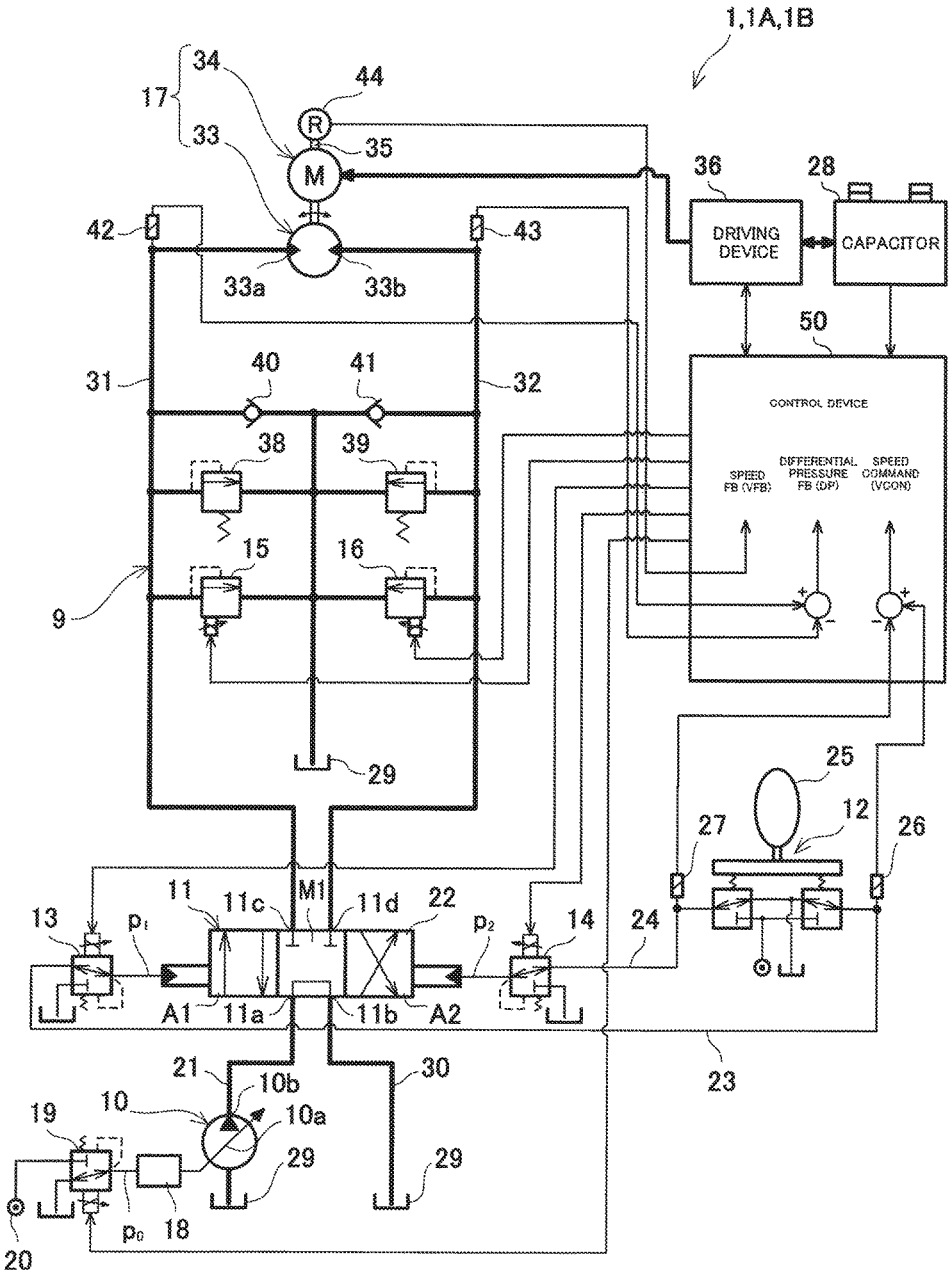
FIG. 2 is a hydraulic circuit diagram showing a hydraulic circuit of the drive control system according to Embodiments 1 to 3 in the hydraulic excavator of FIG. 1.

As shown in FIG. 2, when the operating lever 25 is inclined toward one side, the pilot oil is output to only one of the two pilot passages 23 and 24. Then, the pilot pressure is detected by one of the two pilot pressure sensors 26 and 27, and the detected pilot pressure is input to the control device 50. Differential pressure between the pressure detected by the pilot pressure sensor 26 and the pressure detected by the pilot pressure sensor 27 becomes the speed command signal VCOM. Similarly, the revolution detected by the revolution sensor 44 is input to the control device 50 and becomes the speed feedback signal VFB. The control device 50 calculates target acceleration torque based on a speed difference between the speed command signal VCOM and the speed feedback signal VFB. The control device 50 controls the operations of the hydraulic motor 33 and the electric motor 34 such that the target acceleration torque is output. With this, the turning body 5 can be turned at a speed corresponding to the inclination amount of the operating lever 25, that is, at a speed corresponding to the speed command signal VCOM.

After that, when the operating lever 25 is moved toward the neutral position, the higher pilot pressure decreases. With this, the spool 22 of the control valve 11 moves toward the neutral position M1, and the opening of the control valve 11 becomes small. Further, the oil pressure detected by the pilot pressure sensor 26 and the oil pressure detected by the pilot pressure sensor 27 also decrease. Then, based on the speed difference between the speed command signal VCOM and the speed feedback signal VFB, the control device 50 determines that deceleration control needs to be performed. Thus, the control device 50 starts the deceleration control. In the deceleration control, when the output shaft 35 is decelerated by the electric motor 34, the supply of the electric power from the capacitor 28 to the driving device 36 is stopped, that is, servo-off is performed at a timing when discharge electric power discharged by the steady loss of the driving device 36 becomes larger than charge electric power charged by a regeneration operation of the electric motor 34. Hereinafter, the deceleration control will be specifically explained.

Figure 3:
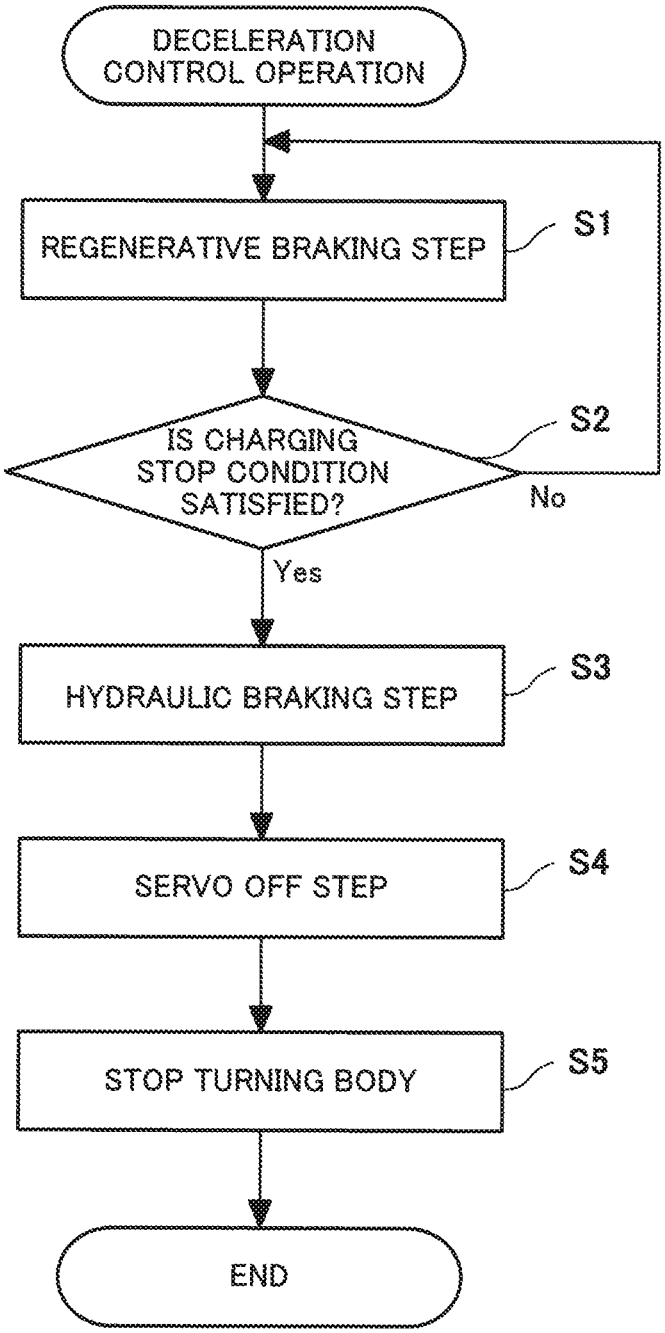
FIG. 3 is a flow chart showing a procedure of a deceleration control operation executed by the drive control system of Embodiment 1.
Figure 4:
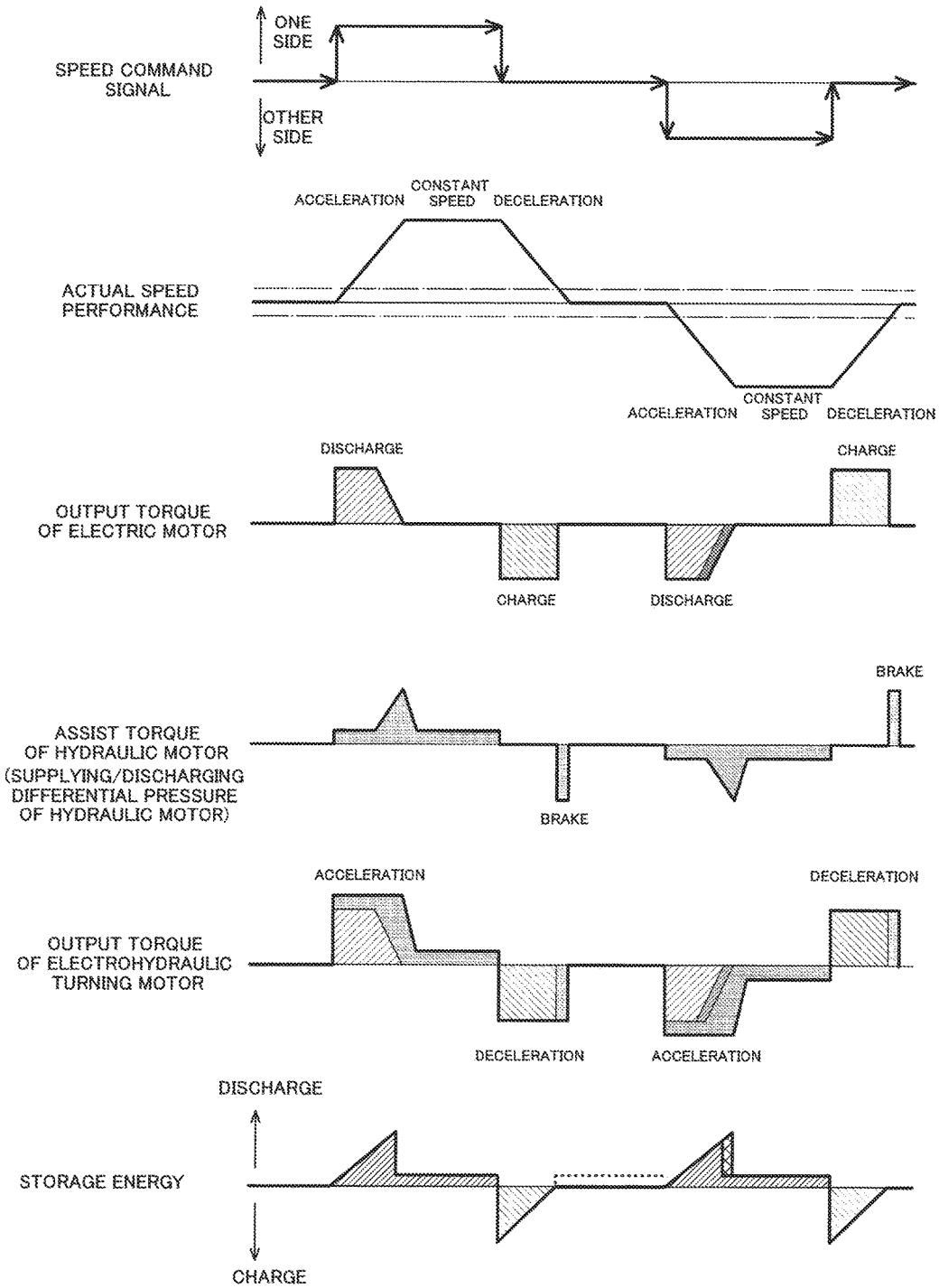
FIG. 4 is a sequence diagram showing time-lapse changes of: a speed command input from an operating lever included in the drive control system of the present invention; an actual speed performance of a turning body with respect to the speed command; output torque of an electric motor; assist torque of a hydraulic motor; output torque of an electrohydraulic turning motor; and storage energy.

When the deceleration control starts, a deceleration control operation starts, and the process proceeds to Step S1 of FIG. 3. In Step S1 that is a regenerative braking step, the control device 50 causes the electric motor 34 to perform the regeneration operation to decelerate the output shaft 35. To be specific, the control device 50 controls the operation of the driving device 36 (i.e., the operations of the switching elements) to cause the driving device 36 to convert the whole alternating current, generated by the electric motor 34, into the direct current and then cause the capacitor 28 to store the whole electric power generated by the electric motor 34, thereby decelerating the output shaft 35. Further, to efficiently perform energy regeneration by the electric motor 34, the control device 50 supplies a command to the electromagnetic relief valve 15 or 16 connected to the discharge-side oil passage 31 or 32 to open the electromagnetic relief valve 15 or 16, thereby adjusting the braking force generated by the hydraulic motor 33. When the output shaft 35 decelerates, the process proceeds to Step S2.

In Step S2 that is a charging stop condition (servo off condition) determining step, the control device 50 determines whether or not a charging stop condition is satisfied. The charging stop condition is a condition that regardless of the forward direction or the opposite direction, the speed of the turning body 5 is a predetermined speed or less (i.e., an absolute value of the speed of the turning body 5 is the predetermined speed or less). Further, the predetermined speed is a speed at which steady loss energy consumed by the electric motor 34 and the driving device 36 when braking the turning body 5 becomes larger than the charging electric power generated by the electric motor 34. The predetermined speed is set in accordance with the structures of the electric motor 34 and the driving device 36 and various components connected to the electric motor 34 and the driving device 36. Based on the revolution detected by the revolution sensor 44, the control device 50 determines whether or not the speed of the turning body 5 is the predetermined speed or less. When it is determined that the speed of the turning body 5 exceeds the predetermined speed, the process returns to Step S1, and the regeneration operation is continuously performed by the electric motor 34. In contrast, when it is determined that the speed of the turning body 5 is the predetermined speed or less, the process proceeds to Step S3.

In Step S3 that is a hydraulic braking step, the control device 50 controls the operation of the operating oil supply device 9 to cause the hydraulic motor 33 to turn the turning body 5. More specifically, the control device 50 supplies a command to the discharge-side electromagnetic relief valve 15 or 16 to reduce an opening degree thereof (increase set pressure of the electromagnetic relief valve), thereby increasing brake torque of the hydraulic motor 33. With this, the braking force can be applied to the output shaft 35, and the turning body 5 can be braked even after the driving device 36 is stopped. When the braking by the hydraulic motor 33 starts, the process proceeds to Step S4.

In Step S4 that is a servo off step, the control device 50 stops the supply of the driving electric power to the driving device 36. More specifically, the control device 50 transmits a servo off command to the driving device 36 to turn off the switching elements in the driving device 36. With this, the driving device 36 and the capacitor 28 are disconnected from each other, and the driving device 36 is stopped. Thus, the steady loss of the driving device 36 and the electric motor 34 at the time of the braking can be eliminated, and it is possible to prevent a case where the electric power of the capacitor 28 is consumed although the regeneration operation of the electric motor 34 is being performed. After the driving device 36 and the capacitor 28 are disconnected from each other, the process proceeds to Step S5.

In Step S5 that is a turning body stopping step, regardless of the forward direction or the opposite direction, the output shaft 35 is continuously braked until the speed of the turning body 5 becomes substantially zero (that is not more than a speed at which it may be determined that the turning body 5 has stopped). Specifically, based on the revolution detected by the revolution sensor 44, the control device 50 determines whether or not the speed of the turning body 5 is substantially zero. When the control device 50 determines that the speed of the turning body 5 is not substantially zero, the control device 50 keeps on applying the braking force to the output shaft 35. Then, when it is determined that the speed of the turning body 5 is substantially zero, that is, it is determined that the turning body 5 has stopped, the deceleration control of the turning body 5 terminates.

When the speed of the turning body 5 becomes the predetermined speed or less, the drive control system 1 configured to execute the above deceleration control stops the supply of the driving electric power to the driving device 36. Therefore, it is possible to prevent a case where the electric power of the capacitor 28 is consumed by the steady loss of the driving device 36 and electric motor 34 at the time of the deceleration braking. With this, the electric power (see a dotted line portion shown in STORAGE ENERGY of FIG. 4), which was consumed by the steady loss in conventional cases, can be utilized as the electric power (see a hatching portion shown in STORAGE ENERGY of FIG. 4) for turning the turning body 5 next time. Therefore, regeneration efficiency of the drive control system 1 can be further improved.

Embodiment 2

Figure 5:
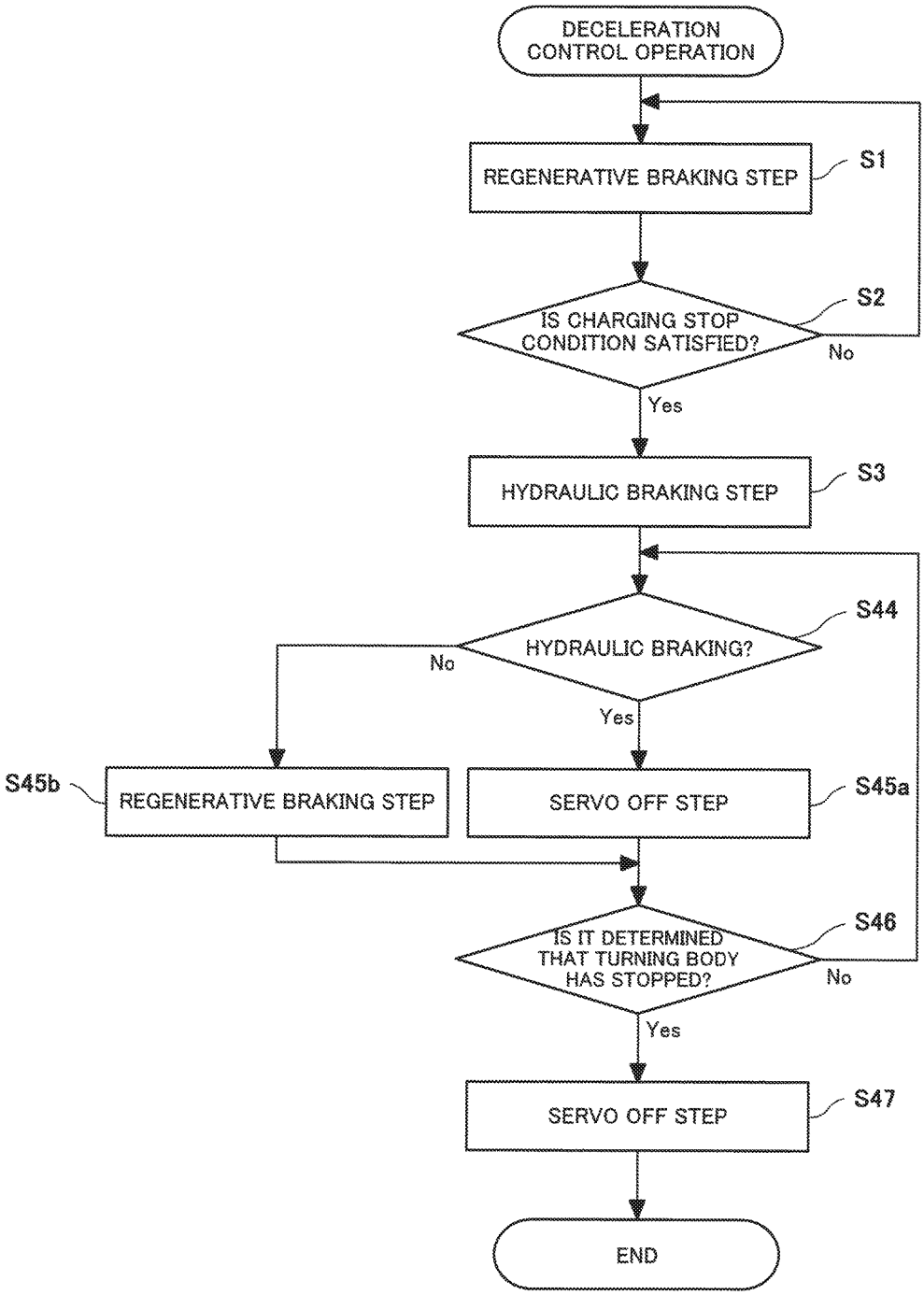
FIG. 5 is a flow chart showing a procedure of the deceleration control operation executed by the drive control system of Embodiment 2.

The drive control system 1A of Embodiment 2 is the same in configuration as the drive control system 1 of Embodiment 1, but the procedure of the deceleration control operation is different as shown in FIG. 5. Hereinafter, the deceleration control operation of the drive control system 1A of Embodiment 2 will be explained. In the following explanation, the same reference signs as the components of the drive control system 1 of Embodiment 1 are used for the same components of Embodiment 2. The same is true for the drive control system 1B of Embodiment 3.

In the drive control system 1A of Embodiment 2, the charging stop condition (servo off condition) includes not only the condition that the speed of the turning body 5 is the predetermined speed or less regardless of the forward direction and the opposite direction but also a condition that the inclination amount of the operating lever 25 (i.e., the adjustment value of the input device) is a predetermined amount or less regardless of the inclination direction (i.e., the absolute value of the inclination amount of the operating lever 25 is the predetermined amount or less). The predetermined amount is such an inclination amount that even when the operating lever 25 is inclined, an opening area of the control valve 11 does not change (the spool 22 does not move).

In the deceleration control operation of the drive control system 1A of Embodiment 2, Step S44 that is a hydraulic braking determining step is performed after Step S3 that is the hydraulic braking step. In Step S44, based on the pressure detected by the hydraulic sensor 42 and the pressure detected by the hydraulic sensor 43, the control device 50 determines whether or not the brake torque of the hydraulic motor 33 is being generated. Specifically, the hydraulic sensors 42 and 43 detect supply-side oil pressure and discharge-side oil pressure of the hydraulic motor 33, and when the discharge-side oil pressure is higher than the supply-side oil pressure, it is determined that the brake torque is being generated. When it is determined that the brake torque is being generated, the process proceeds to Step S45*a* that is the servo off step. Further, when the discharge-side oil pressure is lower than the supply-side oil pressure, the control device 50 determines that the brake torque is not being generated, and the process proceeds to Step S45*b* that is the regenerative braking step.

In Step S45*a*, as with Step S4 in Embodiment 1, the control device 50 switches the switching elements of the driving device 36 to disconnect the driving device 36 and the capacitor 28 from each other. With this, the turning body 5 is decelerated only by the brake torque generated by the hydraulic motor 33. On the other hand, in Step S45*b*, as with Step S1 in Embodiment 1, the control device 50 causes the electric motor 34 to perform the regeneration operation, thereby decelerating the turning body 5. After the turning body 5 is decelerated in Step S45*a* or Step S45*b*, the process proceeds to Step S46.

Next, in Step S46 that is a turning body stop determining step, the control device 50 determines whether or not the turning body 5 has stopped. Specifically, when the speed of the turning body 5 is substantially zero (that is not more than a speed at which it may be determined that the turning body 5 has stopped), and the absolute value of the inclination amount is the predetermined amount (that is such an inclination amount that even when the operating lever 25 is inclined, the opening area of the control valve 11 does not change, and therefore, the supply of the pressure oil to the hydraulic motor 33 is not yet started) or less, the control device 50 determines that the turning body 5 has stopped, and the process proceeds to the servo off step S47. On the other hand, when the above two conditions (i.e., the condition that the speed of the turning body 5 is substantially zero and the condition that the absolute value of the inclination amount of the operating lever 25 is the predetermined amount or less) are not satisfied, the control device 50 determines that the turning body 5 is not stopped, and the process returns to Step S44.

In the servo off step S47, the control device 50 transmits the servo off command to the driving device 36 to disconnect the driving device 36 and the capacitor 28 from each other, thereby stopping the driving device 36 (servo off operation). To be specific, the servo off operation is executed when the process has passed through Step S45*b*. It should be noted that when the driving device 36 and the capacitor 28 has already been disconnected from each other in Step S45*a* (i.e., when the servo off operation has already been performed), the disconnection between the driving device 36 and the capacitor 28 is maintained. After the servo off operation is performed as above, the deceleration control operation terminates.

In the drive control system 1A configured to perform such deceleration control operation, when the inclination amount of the operating lever 25 is the predetermined amount or less, and the turning body 5 is in a stop state, the supply of the driving electric power to the driving device 36 is stopped. Therefore, it is possible to prevent a case where the electric power of the capacitor 28 is consumed by the steady loss of the driving device 36 and the electric motor 34 while the turning body 5 is in a stop state. Other than the above, the drive control system 1A has the same operational advantages as the drive control system 1 of Embodiment 1.

Embodiment 3

Figure 6:
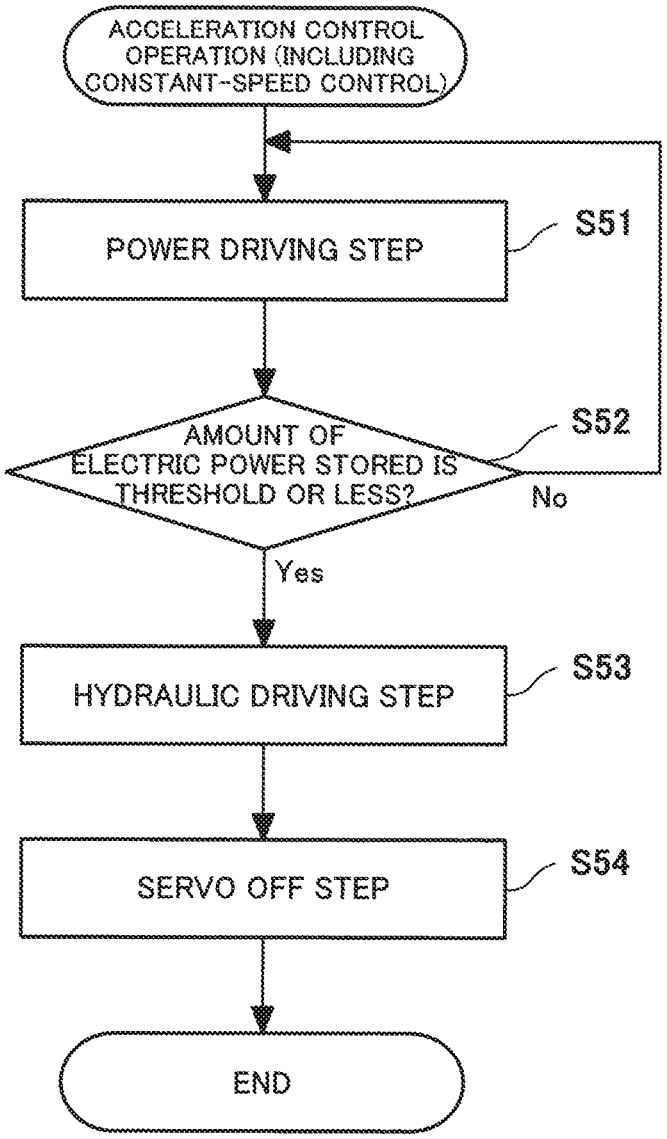
FIG. 6 is a flow chart showing a procedure of an acceleration/constant-speed control operation executed by the drive control system of Embodiment 3.

The drive control system 1B of Embodiment 3 executes an acceleration/constant-speed control operation explained below. In the acceleration/constant-speed control operation, as shown in the flow chart of FIG. 6, when the amount of electric power stored in the capacitor 28 is a predetermined value or less at the time of the acceleration of the turning body 5 or constant-speed turning of the turning body 5, target torque of the electric motor 34 is set to zero. With this, the turning body 5 is switched to be turned only by the hydraulic motor 33. Further, the electric power consumption of the capacitor 28 by the steady loss of the driving device 36 is prevented by disconnecting the driving device 36 from the capacitor 28. Hereinafter, the procedure of the acceleration/constant-speed control operation will be specifically explained.

In the drive control system 1B, the control device 50 calculates the target acceleration torque based on the speed difference between the speed command signal VCOM and the speed feedback signal VFB. Next, the control device 50 controls the operations of the hydraulic motor 33 and the electric motor 34 such that the target acceleration torque is output. With this, the turning body 5 can be accelerated to the speed corresponding to the inclination amount of the operating lever 25, that is, the speed corresponding to the speed command signal VCOM, or the turning body 5 can be turned at a constant speed that is the speed corresponding to the inclination amount of the operating lever 25, that is, the speed corresponding to the speed command signal VCOM. In the drive control system 1B, the acceleration/constant-speed control operation is executed at the time of such acceleration or constant-speed control of the turning body. When the acceleration/constant-speed control operation is started, the process proceeds to Step S51.

In Step S51 that is a power driving step, the target torque of the electric motor 34 is set in consideration of an operating efficiency of the electric motor 34 (i.e., the target torque of the electric motor 34 is set such that the electric motor 34 drives highly efficiently), and the control device 50 controls the operation of the electric motor 34. After the target torque of the electric motor 34 is set, the process proceeds to Step S52. In Step S52 that is an electric power storage amount determining step, the control device 50 determines whether or not the amount of electric power stored in the capacitor 28 is the predetermined value or less. When it is determined that the amount of electric power stored exceeds the predetermined value, the process returns to Step S51. When it is determined that the amount of electric power stored is the predetermined value or less, the process proceeds to Step S53.

In Step S53 that is a hydraulic driving step, the target torque of the electric motor 34 is set to zero, and the turning body 5 is turned only by the hydraulic motor 33. After the target torque of the electric motor 34 is set to zero, the process proceeds to Step S54.

In Step S54 that is the servo off step, the control device 50 transmits the servo off command to the driving device 36 to turn off the switching elements of the driving device 36. With this, the driving device 36 and the capacitor 28 are disconnected from each other, and the driving device 36 is stopped. After the driving device 36 is stopped, the acceleration/constant-speed control operation terminates.

In the drive control system 1B configured to execute such acceleration/constant-speed control operation, when the amount of electric power stored in the capacitor 28 becomes the predetermined value or less at the time of the acceleration of the turning body 5 or the constant-speed turning of the turning body 5, the supply of the driving electric power to the driving device 36 is stopped. Therefore, it is possible to prevent a case where the electric power of the capacitor 28 is consumed by the steady loss of the driving device 36 and the electric motor 34, the steady loss being generated while the turning body 5 is accelerating or turning at a constant speed.

Other Embodiments

The drive control system 1 of the present embodiment is a system which adjusts the tilting angle of the swash plate 10*a* by a positive control method. However, the drive control system 1 of the present embodiment may be a system which adjusts the tilting angle of the swash plate 10*a* by a negative control method. Further, the hydraulic pump 10 may be a fixed displacement pump in which the tilting angle of the swash plate 10*a* is not adjustable.

The electrohydraulic turning motor 17 configured by integrating the hydraulic motor 33 and the electric motor 34 is used in the drive control system 1 of the present embodiment. However, the hydraulic motor 33 and the electric motor 34 may be configured separately. The electric motor 34 is not necessarily limited to a three-phase AC type electric motor and may be a DC type electric motor. The operating machine to which the drive control system 1 is applied is not limited to the hydraulic excavator 2, and the drive control system 1 may be applied to a hydraulic crane or the like. An operating liquid used in the drive control system 1 of the present embodiment is oil but is not limited to the oil and is only required to be a liquid. Further, in the drive control system 1 of the present embodiment, the brake torque for braking the turning body 5 is generated by using hydraulic braking performed by the hydraulic motor 33. However, the brake torque for braking the output shaft 35 (i.e., for braking the turning body 5) may be generated by using a rotation braking unit such as a mechanical brake.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

REFERENCE SIGNS LIST

1, 1A, 1B drive control system
2 hydraulic excavator
4 turning body
9 operating oil supply device (liquid pressure supply device)
11 control valve
15, 16 electromagnetic relief valve (rotation braking unit)
17 electrohydraulic turning motor
22 spool
28 capacitor (power storage device)
29 tank
33 hydraulic motor
34 electric motor
35 output shaft
36 driving device
44 revolution sensor
50 control device

The invention claimed is:

1. A drive control system of an operating machine,
the drive control system comprising:
an electric motor configured to receive supply of electric power to turn a turning body of the operating machine and configured to generate the electric power to brake the turning body;
a power storage device configured to charge and discharge the electric power;
a driving device driven by driving electric power supplied from the power storage device, configured to cause the power storage device to supply the electric power to the electric motor to operate the electric motor, and configured to cause the power storage device to store the electric power, generated by the electric motor, to brake the turning body;
a speed detector configured to detect a turning speed of the turning body; and
a control device configured to stop the supply of the driving electric power from the power storage device to the driving device when the turning body decelerates, and a charging stop condition is satisfied, the charging stop condition being where the turning speed detected by the speed detector is a predetermined speed or less, and the predetermined speed is a value greater than zero.

2. The drive control system according to claim 1, wherein the predetermined speed is a speed immediately before an electric power state of the power storage device changes from charging to discharging.

3. The drive control system according to claim 1, wherein the predetermined speed is a speed at which steady loss energy consumed by the electric motor and the driving device when braking the turning body becomes larger than charging electric power generated by the electric motor.

4. The drive control system according to claim 1, further comprising:
a liquid pressure motor configured to receive supply of a pressure liquid to turn the turning body in cooperation with the electric motor; and
a liquid pressure supply device configured to supply the pressure liquid to the liquid pressure motor, wherein:
the liquid pressure motor brakes the turning body in such a manner that discharge pressure discharged from the liquid pressure motor is made higher than supply pressure supplied to the liquid pressure motor;
the liquid pressure supply device adjusts the discharge pressure of the liquid pressure motor; and
when the charging stop condition is satisfied, the control device controls an operation of the liquid pressure supply device to increase the discharge pressure of the liquid pressure motor.

5. The drive control system according to claim 4, further comprising a rotation braking unit configured to brake rotation of an output shaft shared by the liquid pressure motor and the electric motor, wherein
when the charging stop condition is satisfied, the control device controls an operation of the rotation braking unit to brake the rotation of the output shaft.

6. The drive control system according to claim 4, further comprising an input device to which an adjustment value regarding the turning speed of the turning body is input, wherein:
the control device controls operations of the driving device and the liquid pressure supply device such that the turning speed of the turning body becomes a turning speed corresponding to the adjustment value output from the input device; and
the charging stop condition includes a condition that the adjustment value output from the input device is a predetermined value or less.

7. A drive control system of an operating machine,
the drive control system comprising:
a liquid pressure motor configured to receive supply of a pressure liquid to turn a turning body;
a liquid pressure supply device configured to supply the pressure liquid to the liquid pressure motor;
an electric motor configured to receive supply of electric power to turn the turning body in cooperation with the liquid pressure motor and configured to generate the electric power to brake the turning body;
a power storage device configured to charge and discharge the electric power;
a driving device driven by driving electric power supplied from the power storage device, configured to cause the power storage device to supply the electric power to the electric motor to operate the electric motor, and configured to cause the power storage device to store the electric power, generated by the electric motor, to brake the turning body;

a speed detector configured to detect a turning speed of the turning body; and a control device configured to stop the supply of the driving electric power from the power storage device to the driving device when the turning body accelerates or turns at a constant speed, and an assist stop condition is satisfied, the assist stop condition including a condition that an amount of electric power stored in the power storage device is a predetermined value or less.

8. An operating machine comprising:

the drive control system according to claim 1; and the turning body, wherein the electric motor turns the turning body via a reducer.

9. A drive control method of a drive control system of an operating machine, the drive control method comprising:

a speed detecting step of detecting a turning speed of a turning body of the operating machine, the turning body being turned by an electric motor driven by electric power supplied from a power storage device;

a determining step of determining whether or not a charging stop condition is satisfied when the turning body is decelerated in such a manner that the driving device stores the electric power, generated by the electric motor, in the power storage device to brake the turning body, the charging stop condition being where the turning speed detected in the speed detecting step is a predetermined speed or less, and the predetermined speed is a value greater than zero, or a determining step of determining whether or not an assist stop condition is satisfied when the turning body accelerates or turns at a constant speed, the assist stop condition including a condition that an amount of electric power stored in the power storage device is a predetermined value or less; and a stopping step of stopping the supply of the electric power from the power storage device to the driving device when it is determined in the determining step that the charging stop condition or the assist stop condition is satisfied.

* * * * *